United States Patent [19]

Hosoya

[11] Patent Number: 4,614,340

[45] Date of Patent: Sep. 30, 1986

[54] SMOKE EMITTING GAME BALL

[75] Inventor: Fumio Hosoya, Akigawa, Japan

[73] Assignee: Hosoya Pyrotechnics Co., Ltd., Tokyo, Japan

[21] Appl. No.: 676,721

[22] Filed: Nov. 30, 1984

[51] Int. Cl.[4] ..... A63B 43/00; A63B 69/36; A63B 37/06

[52] U.S. Cl. ..... 273/60 B; 273/213; 102/334

[58] Field of Search ..... 273/213, 60 R, 60 B, 273/58 R, 58 A; 102/334; 272/8 N, 20

[56] References Cited

U.S. PATENT DOCUMENTS 1,461,646 7/1923 French et al. ..... 102/334 X 3,233,544 2/1966 Hosoya ..... 102/334

*Primary Examiner*—George J. Marlo

*Attorney, Agent, or Firm*—Darby & Darby

[57] ABSTRACT

According to the invention, a smoke emission device such as a golf ball or a baseball game ball which emits attactive smoke while flying is provided for entertainment display. The smoke emission device includes a central core of a detonator material, a layer of a smoke emitting material and an outer shell having apertures for allowing the smoke to pass therethrough. A wire net between 100 and 10 mesh is interposed between the outer shell and the layer of the smoke emitting material to cover at least the apertures to thereby prevent hot molten mass of the combustion product from spilling out of the apertures.

3 Claims, 1 Drawing Figure

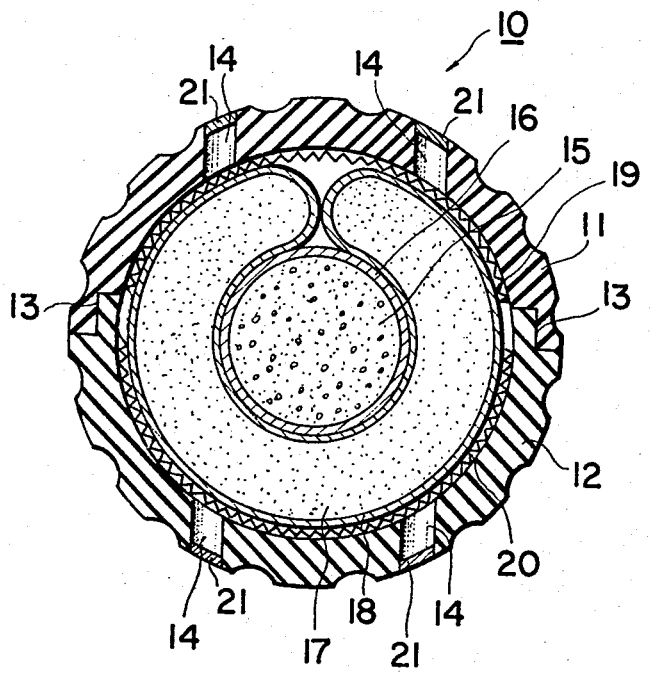
10
14
14
21
21
16
15
19
11
13
13
12
20
14
21
17
18
21
14

SMOKE EMITTING GAME BALL

BACKGROUND OF THE INVENTION

1. Field of the Invention

The present invention relates generally to a smoke emission device, and more particularly to an improvement in in the smoke emission devices which fly and emit attractive smoke upon application of impact force to exhibit entertainment display. The device of the invention is normally supplied in the form of a golf ball or a ball for baseball game.

2. Prior Art

Smoke emission devices, in the form of golf balls or balls for baseball game, were known, for example, by the specification of U.S. Pat. No. 3,233,544 entitled with "Signalling Device". The device disclosed by the preceding Patent comprises a generally spherical central core of detonator material, a layer of smoke emitting fumigant pellets surrounding said core completely, and a thin outer confining shell surrounding said layer of said smoke emitting fumigant pellets. When the outer shell has a sharp blow imparted thereto, friction is created in the central core to ignite the detonator. Then, the smoke emitting fumigant pellets are ignited to produce smoke which is emitted through a plurality of apertures provided through the outer shell so that the ball flies while leaving attractive smoke tail.

However, the known smoke emission ball has a tendency of spilling extremely high temperature droplets of molten mass resulting from combustion of the detonator material through the apertures on the outer shell to cause hazard. If the ball falls on or at the vicinity of a flammable material, such as dried grass, there is a risk that a fire is caused by the extremely hot molten mass which spills out of the apertures.

OBJECTS AND SUMMARY OF THE INVENTION

The principal object of this invention is to exclude the hazard caused by the prior art smoke emission device.

More specifically, an object of this invention is to provide a smoke emission device including means for preventing the high temperature molten mass produced by combustion of the detonator from spilling out of the aperture provided through the outer shell to eliminate the risk of a fire.

A further object of this invention is to provide a smoke emission device including means for cooling heat generated by the combustion of the detonator and smoke emitting fumigant materials relatively rapidly to improve safety.

The present invention is directed to an improved smoke emission device including a central core of a detonator material, a layer of a smoke emitting material surrounding said detonator material to be ignited by said detonator material upon impact thereof to emit smoke, and an outer shell covering said layer of said smoke emitting material and having at least one aperture for allowing the smoke to pass therethrough, the improvement wherein a wire net is interposed between said layer of said smoke emitting material and said outer shell to extend at least below said aperture.

BRIEF DESCRIPTION OF THE DRAWING

The single FIGURE appended hereto is a diagrammatical elevation, taken along a diametral plane, of a golf ball embodying the device of the invention.

DESCRIPTION OF A PREFERRED EMBODIMENT

The present invention will now be described in detail by referring to a preferred embodiment shown in the drawing.

A golf ball embodying the smoke emission device of the invention is generally denoted by reference numeral 10 in the FIGURE. The golf ball 10 has an outer shell formed of two generally hemispherical segments 11 and 12 which are coupled together by means of rabbet joints 13. The hemispherical segments 11 and 12 are made of a tough material, such as a synthetic rubber, to withstand intensive impact or blow and firmly united together to form sound integral shell by applying a suitable adhesive on the interfaces of the rabbeted portions 13. A plurality of apertures 14 penetrate through the walls of the segments 11 and 12 to allow passage of smoke. The outer opening of each aperture 14 may be covered with a piece of thin paper 21 which is preferably coated to have an apperance resembling the outer skin of the rubber shell.

A detonator material 15 is contained in a polyethylene pouch 16 and disposed centrally of the golf ball 10. The detonator material may be made of, for example, pellets which are formed by coating a solution of celluloid in amyl alcohol added with a mixture composed of 70 to 80 wt% of trilead tetraoxide and 20 to 30 wt% of ferrosilicon on fine stone powders followed by drying. A smoke emitting powder 17 contained in a separate polyethylene bag 18 surrounds the core 15 of detonator material. The composition of the smoke emitting powder 17 may be changed depending on the desired smoke color, the illustrative examples being as follows:

(1) Red Smoke Emitting Powder Composition:
Potassium Chlorate: 23 to 33 wt%
Rice Granules: 3 to 7 wt%
Starch: 9 to 15 wt%
Pigment Red 1: 25 to 35 wt%
Beige Violet 10: 20 to 30 wt%

(2) Blue Smoke Emitting Powder Composition:
Potassium Chlorate: 30 to 40 wt%
Rice Granules: 3 to 7 wt%
Strach: 4 to 10 wt%
Pigment Blue 15: 32 to 42 wt%
Vat Blue: 11 to 21 wt%

According to the advantageous aspect of the invention, metal wire nets 19 and 20 are disposed adjacent to the inner peripheries of the outer shell segments 11 and 12 to cover the apertures 14. The wire nets 19 and 20 secure safe use of the smoke emission device as will be described hereinbelow.

As the golf ball 10 is hit to be applied with an impact force, the detonator 15 is ignited to allow the smoke emitting material 17 to catch fire. The thin paper pieces 21 are ruptured by the combustion gas pressure so that the golf ball 10 flies while leaving attractive smoke tail, and then falls down to the earth. If the ball 10 having no wire net is fallen on or at the vicinity of a flammable material, there is a risk that a fire is caused by the extremely hot molten mass of combustion product of the detonator material 15 spilt out of the apertures 14. On the contrary, according to the present invention, the molten mass of combustion product is prevented from spilling by the wire nets 19 and 20 and securely confined in the outer shell of the ball. Furthermore, the wire nets 19 and 20 absorb heat and facilitate conduction of heat so that the ball is cooled relatively rapidly.

It is desirous that the mesh size of the wire nets ranges within 100 to 10 meshes. If the wire net is finer than 100 meshes, passage of smoke through the nets is hindered to result in adherence of smoke particles which coagulate to form large drops to impair smoking effect. On the contrary, if the wire net is coarser than 10 meshes, there is the fear that the molten mass of combustion product leaks through the wire net grating. In order to ensure the cooling effect by the wire nets, it is desirous that the wire nets 19 and 20 extends to cover not less than two thirds of the overall internal surface area of the outer shell. The material of the wire nets is not particularly limited, provided that it withstands heat generated by the combustion. The nets may be made of iron or steel plated with zinc.

Although the present invention had been described with reference to the preferred embodiment, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. A spherical game ball for emitting smoke comprising:

a central core of a detonator material; a layer of a smoke emitting material surrounding said detonator material to be ignited by said detonator material upon impact thereof to emit smoke; an outer shell covering said layer of said smoke emitting material and having at least one aperture for allowing the smoke to pass therethrough; and a wire net interposed between said layer of said smoke emitting material and said outer shell extending at least below said aperture, said wire net being between 100 and 10 mesh and extending to cover not less than two thirds of the overall internal surface area of said outer shell for preventing the ignited smoke emitting material from spilling out of said aperture.

2. The game ball of claim 1 wherein said wire net comprises iron or steel plated with zinc.

3. The game ball of claim 1 wherein said outer shell comprises a synthetic rubber material.

* * * * *